US005553426A

United States Patent [19]

Ostergaard

[11] Patent Number: 5,553,426

[45] Date of Patent: Sep. 10, 1996

[54] GRAVESITE ACCESSIBLE MEMORABILIA STORAGE SYSTEM

[76] Inventor: Denton L. Ostergaard, 11033 Washington St., Omaha, Nebr. 68137

[21] Appl. No.: 82,792

[22] Filed: Jun. 28, 1993

[51] Int. Cl.[6] ..... E04H 13/00

[52] U.S. Cl. ..... 52/103; 40/124.5

[58] Field of Search ..... 52/103, 104; 70/160, 70/161, 423; 40/124.5

[56] References Cited

U.S. PATENT DOCUMENTS 3,726,052 4/1973 Thompson ..... 52/103

FOREIGN PATENT DOCUMENTS 2031178 3/1993 Canada ..... 52/103

*Primary Examiner*—Carl D. Friedman
*Assistant Examiner*—Creighton Smith
*Attorney, Agent, or Firm*—Philip J. Lee

[57] ABSTRACT

A waterproof gravesite accessible-memorabilia storage system having an easily openable key-locked lid. The lock is of the moving latch type and the lock is openable at the top of the container. The container is anchored by an anchor therebeneath buried under the ground. Waterproofing is done with gasketing. The anchor is of a type easily transportable, using heavy material such as the ground itself for stabilization. Such material is disposed between the anchor and the container.

10 Claims, 2 Drawing Sheets

GRAVESITE ACCESSIBLE MEMORABILIA STORAGE SYSTEM

THE FIELD OF THE INVENTION

This invention is in the field of gravesite monuments, and in the special field of gravesite monuments of a container sort.

BACKGROUND

In the past gravesite monuments have, for the most part, been of solid concrete, stone or metal, without any way of storing any information beyond that which is shown in the lettering on the outside of the monument.

The heavier monuments are protected against theft chiefly by being too heavy to be moved easily. The small plate monuments are too small to sell for enough money to be worth the risk of theft because of the identification printed thereon which would make convincing evidence in court.

OBJECTIVES

An objective hereof is to provide a gravesite container protected from theft by an attached anchor embedded in the earth or in concrete. It is an object of this invention to provide a gravesite monument container which is capable of containing memorables: a photograph album, for example, or tape recordings of audio and visual type, related to the life of the person buried there. Perhaps the container would have in it genealogy.

The container hereof could also contain a large photograph of the deceased particularly as mounted on a flat underside of the lid.

The practicality of this could come immediately to question because of the damaging effects of rain, and of melting snow waters perhaps entering such a container and destroying the contents.

For that reason it is an object of this invention to provide a container made waterproof by compressed gasketing, the compression being accomplished by a special latch put in locked position at a time when great pressure is applied to the lid, such as by a person standing on it.

Theft of the materials in the container is resisted by a lock and the lock is prevented from dust and rust deterioration by a removably attached cover with a gasket.

An objective is to place the lock and the cover in a position spaced downward from the top of the container, so that, if a heavy vehicle should be driven across the top of the container, then the lock itself would not be damaged.

Theft of the entire container would be a most popular thing for thieves with a possibility of selling its contents on the market, a problem when the deceased person is well known.

To take care of this problem, an anchor is provided. It is preferred that the anchor not be large or heavy or expensive. The anchor proposed herein can be what is called a ground anchor. The anchor has a substantial horizontal upper surface and it is buried deep enough into the ground that a substantial amount of ground must be lifted in order to pull the anchor up by pulling on the container itself. So substantial, in fact, as to completely deter the monument container theft, as a practical matter.

Especially is this so, since digging deep to reach and pull out the anchor would make a noticeable activity particularly with graveyard personnel surveying the yard at times with binoculars or with some of the new night-seeing techniques available.

The amount of dirt that would need to be raised out of the way to get the anchor free would be very substantial. In place of the dirt, a large mass of concrete could surround the anchor.

Another objective is to provide a special memorabilia container modification, which has extra safety from leakage because the gasketed joint is higher; higher, where the static pressures of heavy rain waters are not as great.

The special modification also offers a simplicity of construction and a manufacturing cost at minimum.

The special modification also has a more durable gasket mounting because the "U-shaped" gasket wraps around the top edges of the vertical walls of the base portion of the container.

This gives good gasket support, not just from vertical forces, but also from horizontal displacement forces.

A special lid-hinge-axis position assures good pressure on this, sealing gasket on all side walls of the container. The special hinge-axis position is synchronized with the lid-latching position for equal gasketting pressure distribution, all around the edge of the lid Leak resistance can be very important over decades of time and over centuries. Extra gasketting assurance is provided by the U-shape of the gasket, when used with a flange or skirt at the lid edges. This gives a horizontal sealing pinch on the gasket, as in addition to the vertical sealing pinch applied by the lids underside.

DESCRIPTION OF THE PREFERRED EMBODIMENT

Figure 1:
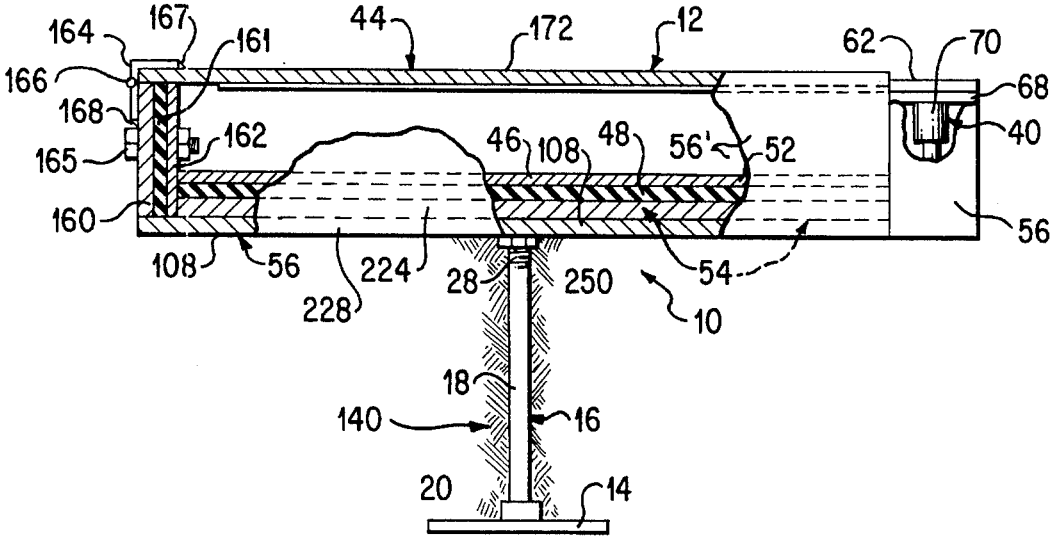
FIG. 1 is a perspective view of the monument container of this invention, shown in use position with parts of the earth, which surrounding the container, being shown cross-section, and parts of the container and anchor being broken away. A portion of the connector which attaches the anchor to the container is broken away to indicate varying depth possibilities.

The gravesite monument container assembly of this invention is generally indicated in FIG. 1 at 10. It has a container generally indicated at 12, an anchor 14, a connecting assembly 16, having a stem or connector 18, attached by its threads 28 to the underside of the container 12 at its upper end.

Figure 2:
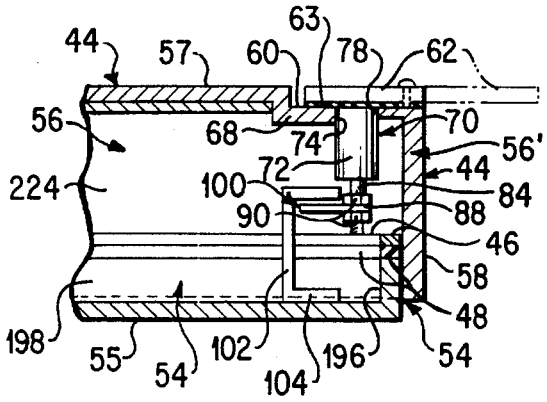
FIG. 2 is a sectional view taken along the line 2—2 of FIG. 5.

In FIG. 1 a locking assembly is generally indicated at 40 and including a lock 70 and a latch 88 and a catch 102 and, optionally, a cover 62, and a gasket 63, all later described. In FIG. 2 it can be seen that the container 12 has a lid 44 which has, attached thereto, a C-shaped skirt 56, having a horizontally inwardly extending portion or presser 46 at a lower part of the lid for engaging the horizontal upper surface of a compressible resilient gasket 48 formed of rubber, or the like. The gasket 48 is mounted on and cemented to a horizontal upper surface 52 of a lapper 54, which is a part of a container base 56.

The lapper 54 is an upwardly projecting flange 54, which is C-shaped in top view. The lapper 54 extends along 3 sides of, and is connected to, and is of a one-piece casting with, a mostly horizontal rectangular bottom wall 55 of a container base 55.

The lapper 54 is adapted to lap the inner side of a lowermost part of the downwardly extending flange 56, or skirt 56, of the lid 44.

The flange or skirt 56 extends down from a horizontal upper lid portion 57, and bas a right section 58 and front and rear section 59.

The lid 44 is rectangular. The presser 46, the gasket 48, and the lapper 54 extend all along the flange 56 and except a later described large gasket at the left end of the container 12.

Figure 5:
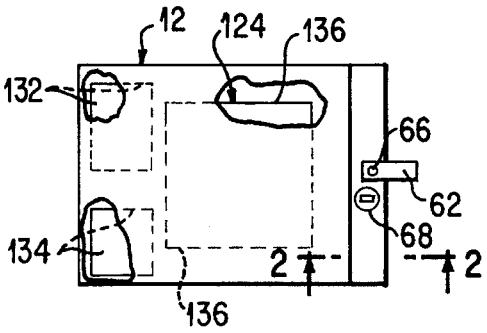
FIG. 5 is a top plan view of the monument container of FIG. 1, with parts broken away.

The upper side of the lid has a downwardly offset portion 68 beneath a recess, seen at 60 in FIGS. 1 and 5, for receiving a lock-protecting cover 62, which is pivotally attached to the lid 44 by a vertical pivot bolt 66, FIG. 5, whereby the cover 62 can swing into place within the outlines of the lid 44 for protecting the keyhole 68 of a lock 70. A resilient gasket 63 of rubber or other material, is attached to the lid 44 and is disposed under the cover 62 and is compressed by the cover 62.

The lock 70 is attached to the lid 44 in the downwardly offset portion 68 thereof, which latter portion forms the lower wall of the recess 60.

Specifically, the upper end of the barrel 72 of the lock 70 is received in a hole 74 extending through the lid offset portion 68. The barrel 72 is cemented at 78 to the sides of the hole 74 in which the barrel 72 is received The lower end of the lock 10 has a key-controlled shaft 84, such as is common in cabinet locks. The shaft 84 has a latch 88 attached thereto. The latch 88 is fixed to the shaft 84 by means of nuts 90 and extends latterly of the shaft 84 toward the center of the container 12 at a time when the lock is in locking position.

The lock 10, its shaft 84, the latch 88, and nuts 90, together form a locking and latching assembly generally indicated at 100.

The latch 88, when in locked position, is adapted to engage the underside of the catch 102, which has a generally horizontally extending underside surface. The catch 102 is attached by a bracket 104 to the bottom or base 56 of the container 12.

Figure 3:
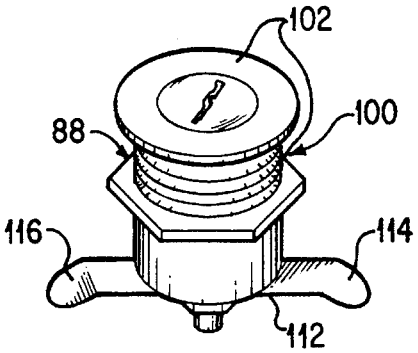
FIG. 3 is a perspective view showing the lock and latch.

As best seen in FIG. 3, the latch 88 has a substantially horizontally extending center portion 112 with downwardly bent portions 114 and 116, on each wide thereof whereby as the lock is opened by the use of a key, rotation of the key would cause rotation of the shaft 84, and of the latch 88. This rotation will cause the latch's downwardly extending end portion 114 to pass under the catch 102 until the higher central portion or horizontal portion 112, is under the catch 102, at which position the latch and catch will be holding the gasket 48 in compression to prevent leakage of ground water into the container 12.

As thus described it will be seen that the container 12, becomes a safe place for water damageable items which can be called generally memorabilia 124.

One such item of memorabilia is a photograph 136 of the deceased which is suitably fixed to the underside of the lid 44.

In general, in FIGS. 1 and 2, the memorabilia can be indicated at 114, and such memorabilia can include audio tape 132, a video tape 134 and a photograph album 136, and such other items as it might be desired to put at the gravesite, such as highly personal items, perhaps the spectacles that were worn in the last years of the person's life or badges, medals or other insignia or jewelry.

Figure 4:
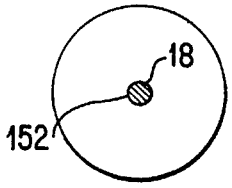
FIG. 4 is a top plan view of the anchor with only the lower part of the post being shown.

FIG. 4 is a top plan view of the anchor 14 and of the connector 18. Earth alongside and under the container 12 and above the anchor 14 and below the anchor 14 is indicated at 140. Instead of this earth, cement can be used above the anchor 14.

At the opposite end 158 of the container 12 from the lock 70, the lid 44 is without a vertical end wall portion, and an endwall is provided by an upwardly extending panel 160, which can be of one piece of thermoplastic with the bottom wall or base 108.

Hinges 164 attach the panel 160 to the lid 44 for hinging about a horizontal axis 166.

On the inner side of the panel 160 is a large rectangular gasket 161, on the inner side of which is a steel plate or presser 162 held against the gasket 160 with high pressure by bolts 165 having rounded exterior heads without slots, and each with a nut at its inner end.

Figure 6:
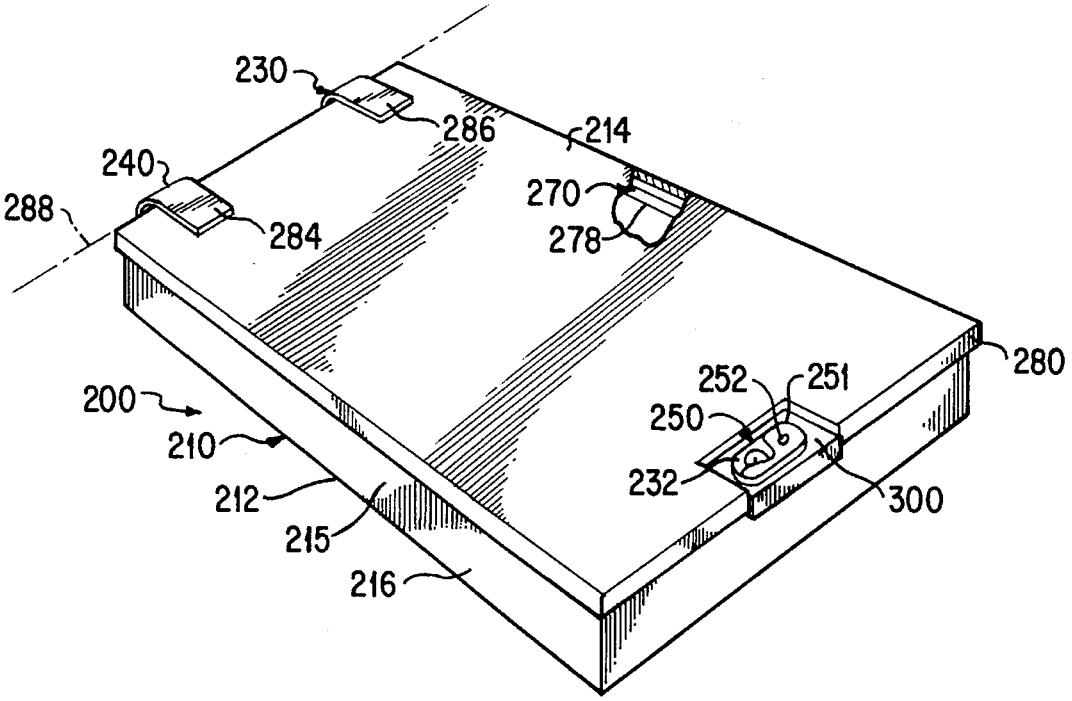
FIG. 6 shows a top-of-wall gasket modification of the invention. Only the container section is shown, lower parts and lock being the same as in FIG. 1. It is shown in lid-closed, locked position. A rubber gasket is visible through a broken away top part of the lid.
Figure 7:
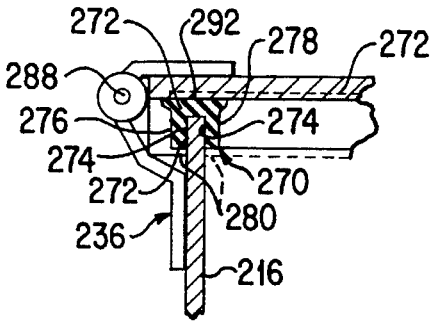
FIG. 7 shows a sectional view of a section adjacent a hinge and axially of the hinge as seen on line 7—7 of FIG. 6. The top of the gasket is compressed by the lid from an original position.

A top-of-the-wall gasket gravesite monument is shown at 200 in FIG. 6. It has a container 210 having a base and a lid 214.

The base 212 has a bottom wall 214 and an upstanding annular sidewall 216.

The lid 214 is movable toward and away from the sidewall 216.

A releasable lid holding assembly 230 has a lock-and-latch assembly 232 as one part, and a hinge assembly 236 as its other part.

The holding assembly 230 holds the lid in a closed position.

The holding assembly 230 has a hinge-assembly 240, as one of its parts, and a lock assembly 250 as the other of its parts.

A gasket assembly 270 extends across the top of all sides of the sidewall and is U-shaped, having a notch 272 in its underside tightly fitting and glued, at 274 to, the top of all sides of the sidewall.

The gasket assembly 270 has a top section 272, an inner section or gasket-skirt 276 the latter being squeezed, in locked position, by an annular flange or skirt 280 depending from the lid 214 and lapping the gasket assembly 270 and sidewall 216.

The lid-flange or lid-skirt 280 extends downwardly on all sides of the container except at the hinge assembly end of the lid The hinge assembly has two hinges 284 and 286 having a common pivot axis 288.

The axis 288 is at a same level with a portion of the gasket assembly 270, which portion 292 is above the sidewall 216. The gasket assembly 270 is compressed along all sides of the container when the lid is closed

I claim:

1. A gravesite accessible memorabilia storage system comprising:

A. a container having
  1. a lid,
  2. a bottom wall beneath the lid,
  3. an annular sidewall attached to the bottom wall and extending upward therefrom, the lid being movable toward and away from the sidewall for opening and closing the container, and
  4. a hinge means attached between the lid and the sidewall;

B. releasable locking means intercorrelated between the lid and the sidewall, on the opposite side of the container from the hinge, for releasably securing the lid to the sidewall, said locking means comprising
  1. a barrel attached to the lid and having a keyhole accessible from the outside of the lid
  2. a catch attached to the bottom wall, and
  3. a latch, attached to the barrel and releasably engageable with the catch to lock and unlock the lid;

C. a gasket means between the lid and the sidewall, capable of causing the container to be substantially waterproof when locked; and D. an anchor disposable beneath the container, substantially spaced therefrom, and a means for connecting the anchor to the container, for deterring theft of the container.

2. The gravesite accessible memorabilia storage system of claim 1, wherein the gasket means comprises a gasket skirt extending down across at least the outside of the sidewall.

3. The gravesite accessible memorabilia storage system of claim 2, wherein the lid comprises a downwardly extending flange which is outwardly displaced from the sidewall upper edge a distance less than the width of the uncompressed gasket skirt, whereby the gasket skirt is compressed against the sidewall between the flange and the sidewall when the lid is in the closed position.

4. The gravesite accessible memorabilia storage system of claim 2, wherein the gasket means further comprises a gasket skirt extending downwardly on the inside of the container sidewall.

5. The gravesite accessible memorabilia storage system of claim 4, wherein the latch is horizontally moveable between locking and unlocking positions.

6. The gravesite accessible memorabilia storage system of claim 5, in combination with the ground, with the upper side of the container visible from the top of the ground and the ground is disposed between the anchor and the container.

7. The gravesite accessible memorabilia storage system of claim 6, in combination with memorabilia of the dead person.

8. The gravesite accessible memorabilia storage system of claim 7, wherein the memorabilia of the dead person comprises at least one photograph.

9. The gravesite accessible memorabilia storage system of claim 7, wherein the memorabilia of the dead person comprises an audio-visual recording means.

10. A gravesite accessible memorabilia storage system comprising:

A. a container having
  1. a lid,
  2. a bottom wall beneath the lid,
  3. an annular sidewall attached to the bottom wall and extending upward therefrom, the lid being movable toward and away from the sidewall for opening and closing the container, and
  4. a hinge means attached between the lid and the sidewall, the container being disposed in combination with the ground with the upper side visible above ground;

B. releasable locking means intercorrelated between the lid and the sidewall, on the opposite side of the container from the hinge, for releasably securing the lid to the sidewall, said locking means comprising
  1. a barrel attached to the lid and having a keyhole accessible from the outside of the lid
  2. a catch attached to the bottom wall, and
  3. a latch, attached to the barrel and releasably engageable with the catch to lock and unlock the lid;

C. a gasket means between the lid and the sidewall, capable of causing the container to be substantially waterproof when locked;

D. deterrent means, disposable at a gravesite and attached to the container, for deterring theft of the container, the deterrent means comprising an anchor disposable beneath the container, substantially spaced therefrom, and a means for connecting the anchor to the container; and E. memorabilia of the dead person comprising photographs and audio-visual recording means.

* * * * *